US005824982A

United States Patent [19]

Kress

[11] Patent Number: 5,824,982

[45] Date of Patent: Oct. 20, 1998

[54] MANUALLY OPERATED TRIGGER OR SWITCH LEVER FOR ELECTRIC APPLIANCES

[75] Inventor: Willy Kress, Bisingen, Germany

[73] Assignee: Kress-Elektrik GmbH & Co. Elektromotorenfabrik, Bisingen, Germany

[21] Appl. No.: 690,299

[22] Filed: Jul. 26, 1996

Related U.S. Application Data

[63] Continuation of Ser. No. 368,725, Jan. 4, 1995, Pat. No. 5,579,902, which is a continuation of Ser. No. 246,488, May 19, 1994, abandoned, which is a continuation of Ser. No. 840,908, Feb. 25, 1992, abandoned.

[30] Foreign Application Priority Data

Feb. 27, 1991 [DE] Germany ..... 41 06 119.5

[51] Int. Cl.[6] ..... H01H 3/12

[52] U.S. Cl. ..... 200/333

[58] Field of Search ..... 200/333, 332.2, 200/302.3, 330, 341, 61.39, 61.85, 522

[56] References Cited

U.S. PATENT DOCUMENTS

| | | | |
|---|---|---|---|
| 2,885,518 | 5/1959 | Bricston | 200/333 |
| 3,296,404 | 1/1967 | Stevens | 200/333 |
| 3,383,943 | 5/1968 | Piber | 200/522 |
| 3,805,003 | 4/1974 | Rennels | 200/61.85 X |
| 3,928,742 | 12/1975 | Rule | 200/302.3 |
| 5,069,082 | 12/1991 | Seng et al. | 200/61.85 X |
| 5,095,409 | 3/1992 | Dematteo et al. | 200/333 |
| 5,164,231 | 11/1992 | Davis | 427/256 |

FOREIGN PATENT DOCUMENTS

| | | |
|---|---|---|
| PS 474 135 | 3/1929 | Germany . |
| 79 03 019 | 2/1979 | Germany . |
| 34 08 088 | 9/1985 | Germany . |
| 89 07 809.8 | 12/1990 | Germany . |

*Primary Examiner*—Renee S. Luebke
*Attorney, Agent, or Firm*—Darby & Darby

[57] ABSTRACT

For a manually operated trigger or switch lever for electric appliances, particularly hand-held electric appliances, such as a portable drill, screwdriver, drilling hammer, grinder, right angle grinder, etc., which, when the appliance is started up, is shifted by the action of pressure applied by the operator and, at the same time, brings about switching processes (switching on and off, accelerating, switching over, reversing) in the appliance, at least the surface of the trigger, which comes in contact with the fingers or a portion of the hand of the operator when pressure is exerted, has at least one elastomeric coating.

10 Claims, 2 Drawing Sheets

MANUALLY OPERATED TRIGGER OR SWITCH LEVER FOR ELECTRIC APPLIANCES

The present invention is a continuation of Ser. No. 08/368,725, filed Jan. 4, 1995, now U.S. Pat. No. 5,579,902, which, in turn, is a continuation of Ser. No. 08/246,488, filed May 19, 1994, now abandoned, which, in turn, was a continuation of Ser. No. 07/840,908, filed Feb. 25, 1992, now abandoned.

BACKGROUND OF THE INVENTION

1. Field of the Invention

The present invention relates to a trigger or switch lever for electric appliances to initiate switching processes in the appliances, such as switching on and off, accelerating, switching over and reversing.

2. Discussion of Related Art

It is well known that hand-held electric appliances, such as drills, drilling hammers and screwdrivers, as well as stationary electric machines can be switched on or off, switched over, for example, to higher speeds or other gears, reversed in the direction of rotation or subjected to other switching processes by manual manipulation or operation of a trigger or switch lever, which is accessible from the outside.

The switches, levers and trigger parts available for this purpose generally consist of a hard plastic, the shape of which is frequently made to fit the hand or the finger of an operator. In the case of a switch that is depressed, they have, for example, a recessed grip. If, as in the case of a hand drill, the handle of the drill together with the trigger is clasped by one hand, the shape of the trigger follows approximately that of the fingers.

In the case of such hard plastic or metal triggers, a problem is encountered in that the hand can slip off these more easily, particularly if the hand is damp from exertion or if oily or watery substances get into the contact area between the hand and/or the finger and the trigger or switch lever surface.

Another problem is that hard handles do not compensate for vibrations or pressure oscillations. Moreover, the hard trigger material is pressed into the soft hand or finger surfaces when the trigger is depressed frequently. Additionally, pressure points and pain develop when pressing power must be exerted over long periods of work, particularly if the same equipment is used constantly and the pressure is time and again exerted in the same places. The same problem occurs when the handle is continuously depressed.

SUMMARY OF THE INVENTION

One aspect of the invention is to provide a remedy and to equip manually operated displaceable elements, such as triggers or switch levers for electric appliances, in such a manner that a manipulation-friendly sensation results when the trigger is depressed or the lever is switched over and this sensation is felt to be pleasant and compensating by the operator.

Due to a rubber-elastic effect, a significantly more advantageous fitting of the shape of the trigger or the switch lever of electrical appliances to the hand or the finger, by which such triggers or switches are operated, is possible in accordance with the invention. Moreover, such is realized independently of the initial, fitted shape of such a trigger. In actual fact, such a preliminary shape, to the extent that it is present at all, can follow only a general profile and therefore cannot correspond to the individual development of the hand of the respective, different user. Due to the elastomeric construction of at least the bearing surface that ensures contact with the trigger of the switch lever, the possibility arises for providing an individual, uniformly soft and pleasant structure, which reacts to pressure in a rubber elastic, yielding manner and thus has a significantly more user-friendly behavior.

Moreover, it is practically impossible for the hand to slip off such a rubber elastic surface. Furthermore, roughness and vibrations during the operation are damped significantly better by the rubber elastic intermediate coating, so that fatigue of the operator in the area of the hand surface or at the finger or fingers, with which the trigger or switch is operated, is reduced appreciably.

It is also possible henceforth to touch such a trigger with a slightly different part of the hand surface or the finger when the appliance is frequently set aside and then turned on again, so that concentrated pressure peaks at the same decay site without any disadvantage resulting from this change in the gripping position, because the rubber elastic surface always adapts itself without problems even to different structures.

Moreover, trials have shown that, when the trigger grip, instead of being rigid, has a flexible surface that is not irritating to the skin and is user friendly, working with appliances so equipped meets with greater approval by the operator. It is more readily possible to maintain a particular trigger position, when the trigger is constructed at the same time as a so-called "accelerator" of electric appliances.

Moreover, either the whole of the trigger can be formed from an elastomeric, rubber elastic material or the trigger carries an elastomeric structure or layer at least at the operationally relevant places. In addition, this elastomeric structure or layer can, for example, be roughened, grained or otherwise structured, in order to ensure a secure seat and, in any case, to prevent slipping off.

It is, for example, possible to produce such a rubber elastic surface separately from a soft polyvinyl chloride, for example, by injection molding and then to mount it on the preshaped trigger surface, for example, by gluing it or by locking it in place on projections by a snap-on connection.

Such a possibility is furthermore advantageous because, by these means, it is also possible to exchange the elastomeric trigger of the switch lever coating when it has become worn out or destroyed or also soiled by oils or fats.

For convenience, both the trigger and switch lever will be referred to as a type of displaceable element.

DESCRIPTION OF THE PREFERRED EMBODIMENT

The present invention includes providing a trigger part, switch lever or other actuating element of an electric appliance, particularly hand-held electrical appliances, with an elastomeric surface at least in the regions, which, when actuated, are exposed to a corresponding pressing power that must also be maintained for a longer time by the user, that is by his hand, or one more of his fingers.

Figure 1:
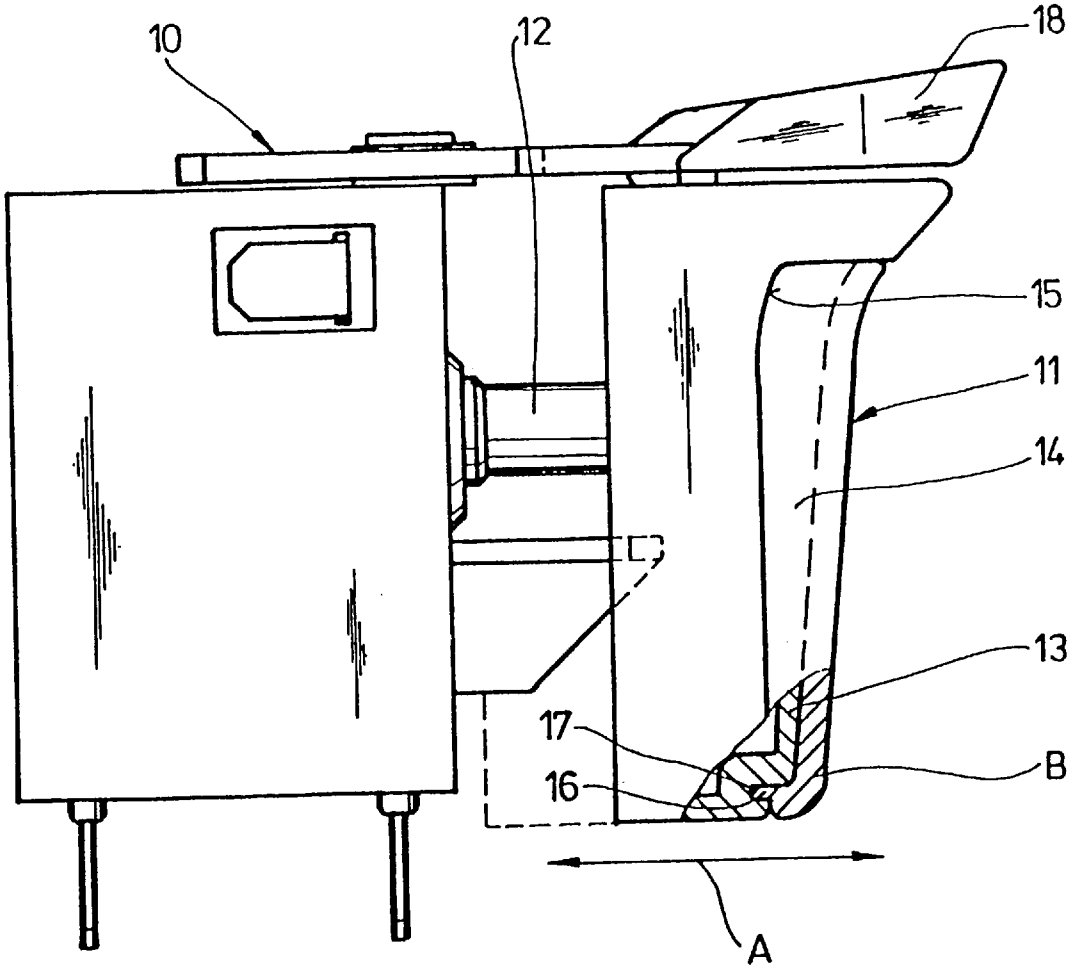
FIG. 1 shows, as a representative of all conceivable embodiments of triggers and switch levers on any electrical equipment, particularly hand-held electrical equipment, a trigger of an electronic switch, which is constructed as an accelerator switch with switching-on function, with a further lever above the trigger for switching over between right and left, in side view and partially in sectional view, the outer surface of the trigger carrying an elastomeric coating in accordance with the principles of the present invention.
Figure 2:
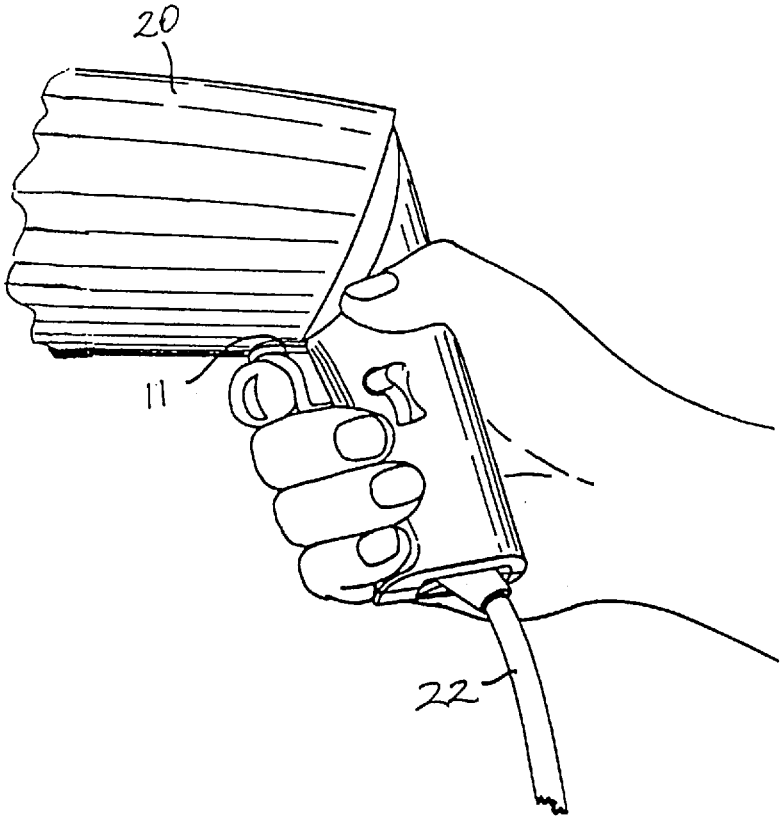
FIG. 2 shows the hand held portion of a hand held electrical appliance on which the trigger of FIG. 1 may be used.

In FIG. 1, a trigger 11 is shown for the electronic regulating or control part 10 of any electric appliance 20 (FIG. 2). The trigger is mounted on an axis 12, which enables the trigger to be moved in the direction of the double arrow A.

This is only one possible example of a trigger or switch lever and the invention is not limited to such an accelerator trigger with switching-on function as used, for example, in connection with a battery-operated drill or screwdriver, but comprises all conceivable embodiments of manually operated triggers or switch levers of electric appliances, including also kitchen appliances, etc., powered through an electrical cord 22 inserted into an electrical outlet. A generic manually operated hand held apparatus 20 is shown in FIG. 2.

It can be seen that the trigger has a rigid basic structure 13 of a convenient shape, which may be, for example, an injection-molded part consisting of a rigid plastic. The outer surface of the trigger 11, which is contacted during the actuation, carries an elastomeric coating 14, which can, for example, have a thickness as given in the lower partial sectional view of the drawing at B.

In the case of this embodiment, the trigger part has a cutout along the line 15 up to a specified depth. This cutout is towards the front, that is, where the pressure is exerted on the trigger by the finger or fingers of the user grasping it. An elastomeric molded part 14 for forming a rubber elastic surface is inserted in the cutout. The connection with the basic structure 13 can be established by gluing or also, by locking or snapping procedure, in that the edge region of the coating, for example, has an inwardly directed edge projection 16, which can be inserted into a corresponding, also closed circumferential accommodating groove 17 of the basic structure 13 of the trigger.

By these means, a rather soft surface, which reacts in a rubber elastic manner, results in the region of the trigger surface, which upon actuation is exposed constantly or also only temporarily to a pressure by the hand or one or several fingers of the operators. This soft surface has a very pleasant feel when the appliance is operated for a longer time and exerts a likable grip, slip-free effect. It is self-evident that the nature and manner of the elastomeric, that is, rubber elastic shaping of the trigger or switch lever can find expression in a plurality of realization forms. For example, the trigger may be formed completely from the respective elastomeric material, such as a soft PVC, and connected to the axis. On the other hand, as indicated in principle in the drawings, forms may be produced in two or more parts, which are then connected with one another. The elastomeric area may be made larger in surface, or also more extended in thickness, so that the cushion-like, likable grip effect on the user is intensified, because the elastomeric coating or the elastomeric construction of the trigger results in a certain resilience also in the pressure direction. This resilience makes possible a softer actuation process and generally a more friendly transition to the always soft and resiliently reacting hand parts of the operator.

It is well known that the concept of an elastomer comprises a plurality of materials, even of materials of completely different origin, with largely rubber elastic behavior, including materials such as acrylate rubber, polyester urethane rubber, polybutadiene, natural rubber, thioplasts and a plurality of additional materials, which are not listed individually here. The elastomeric coating preferably is composed of a material selected from the group consisting of soft polyvinyl chloride, natural rubber, polybutadiene, acrylate rubber, polyester, urethane rubber, thioplasts and any combination thereof.

If desired, such partial areas of adjusting levers, switch levers, triggers, etc. may also be provided with an elastomeric coating or consist of an elastomer, as the direction reversing or right/left change-over lever 18, which is shown in FIG. 1 above the trigger 11 and which can consist of an elastomer on its bilateral actuating surfaces or also as a whole.

The coating may be structured additionally on its external surface, that is, worked in fine roughnesses or grain, in order to achieve a better grip in this way.

While the foregoing description and drawings represent the preferred embodiments of the invention, it will be understood that various changes and modifications may be made without departing from the spirit and scope of the present invention.

What is claimed is:

1. A manually operated displacement element mounted on a hand-held manually operated apparatus that can start up and effect switching processes, the hand-held apparatus having a housing with a hand-held portion, said manually operated displaceable element being moveable with respect to the hand-held portion of the housing by the application of manual pressure on said manually operated displacement element by an operator controlling the apparatus, said manually operated displaceable element comprising:

at least first and second parts, said first part comprising a rigid basic structure having an actuation surface positioned for extended manual pressure applied by the operator in order to actuate the hand-held apparatus by shifting said manually operated displaceable element with respect to the hand-held portion of said housing to thereby shift an actuating member within the housing of the hand-held apparatus, and said second part comprising an elastomeric coating providing a resilient cushion for the operator, said second part covering at least a portion of said actuation surface;

said displaceable element extending from the housing of the manually operated apparatus;

said rigid basic structure has a side surface extending from said actuation surface and toward the housing; and said elastomeric coating covers said actuation surface and leaves a portion of said side surface between said elastomeric coating and the housing free from being covered by said elastomeric coating.

2. A manually operated displaceable element as in claim 1, wherein said elastomeric coating covers said actuation surface and at least a portion of said side surface immediately adjacent said actuation surface, such that the majority of said side surface is not covered by said elastomeric coating.

3. A manually operated displaceable element mounted on a hand-held manually operated apparatus that can start up and effect switching processes, the hand-held apparatus having a housing with a hand-held portion, said manually operated displaceable element being moveable with respect to the hand-held portion of the housing by the application of manual pressure on said manually operated displaceable element by an operator controlling the apparatus, said manually operated displaceable element comprising:

at least first and second parts, said first part comprising a rigid basic structure having an actuation surface positioned for extended manual pressure applied by the operator in order to actuate the hand-held apparatus by shifting said manually operated displaceable element with respect to the hand-held portion of said housing to thereby shift an actuating member within the housing of the hand-held apparatus, and said second part comprising an elastomeric coating providing a resilient cushion for the operator, said second part covering at least a portion of said actuation surface; and wherein said elastomeric coating completely covers said first part of said manually operated displaceable element.

4. A manually operated displacement element mounted on a hand-held manually operated apparatus that can start up and effect switching processes, the hand-held apparatus having a housing with a hand-held portion, said manually operated displaceable element being moveable with respect to the hand-held portion of the housing by the application of manual pressure on said manually operated displaceable element by an operator controlling the apparatus, said manually operated displaceable element comprising:

at least first and second parts, said first part comprising a rigid basic structure having an actuation surface positioned for extended manual pressure applied by the operator in order to actuate the hand-held apparatus by shifting said manually operated displaceable element with respect to the hand-held portion of said housing to thereby shift an actuating member within the housing of the hand-held apparatus, and said second part comprising an elastomeric coating providing a resilient cushion for the operator, said second part covering at least a portion of said actuation surface; and wherein said elastomeric coating is glued to said actuation surface.

5. A manually operated hand-held apparatus that can start up and effect switching processes, said hand-held apparatus comprising:

a housing having a handle portion;

a displaceable element having a front actuation surface positioned to be contacted by the operator of said apparatus to move said displaceable element with respect to said handle portion of said housing to operate said apparatus;

wherein at least said actuation surface comprises an elastomeric surface of a predetermined thickness such that said elastomeric surface reacts in a rubber elastic manner and provides a predetermined resilience in response to pressure applied by the operator to said actuation surface during operation of said apparatus to provide a resilient cushion for the operator during use;

wherein said displaceable element comprises a rigid basic structure and an elastomeric coating comprising said elastomeric surface; and wherein said rigid basic structure is shaped to accommodate said elastomeric coating.

6. A manually operated hand-held apparatus that can start up and effect switching processes, said hand-held apparatus comprising:

a housing having a handle portion;

a displaceable element having a front actuation surface positioned to be contacted by the operator of said apparatus to move said displaceable element with respect to said handle portion of said housing to operate said apparatus;

wherein at least said actuation surface comprises an elastomeric surface of a predetermined thickness such that said elastomeric surface reacts in a rubber elastic manner and provides a predetermined resilience in response to pressure applied by the operator to said actuation surface during operation of said apparatus to provide a resilient cushion for the operator during use; and wherein said displaceable element has a side surface extending from said actuation surface and toward said housing, said elastomeric surface covering said actuation surface and leaving a portion of said side surface between said elastomeric coating and said housing free from being covered by said elastomeric surface.

7. A manually operated apparatus as in claim 6, wherein said elastomeric surface covers said actuation surface and at least a portion of said side surface immediately adjacent said actuation surface, such that the majority of said side surface is not covered by said elastomeric surface.

8. A hand held electric appliance comprising:

a housing having a portion shaped to be engaged by the hand of an operator;

a moveable member for causing actuation of said appliance upon movement relative to said housing; and a displaceable element in operative contact with said movable member and movable with respect to said housing with said moveable member;

wherein:

said displaceable element is positioned to be engaged by at least a finger of the hand of the operator and displaced by the finger to move said movable member and actuate said appliance;

said displaceable element further comprises an outer contact surface positioned for engagement with the finger of the operator when the hand of the operator is wrapped around said portion of said housing shaped to be engaged by the hand of an operator; and said contact surface includes an elastomeric surface of a predetermined thickness to provide sufficient resiliency for dampening vibrations caused by actuation of said appliance, for adapting to different operator fingers, and for cushioning the finger of the operator during actuation of said appliance by moving said displaceable element with respect to said portion of said housing shaped to be engaged by the hand of an operator;

wherein said displaceable element has a side surface extending from said outer contact surface and toward said housing, said elastomeric surface covering said contact surface and leaving a portion of said side surface between said elastomeric surface and said housing free from being covered by said elastomeric surface to permit free sliding movement between said displaceable element and said housing.

9. A hand held electric appliance comprising:

a housing having a portion shaped to be engaged by the hand of an operator;

a moveable member for causing actuation of said appliance upon movement relative to said housing; and a displaceable element in operative contact with said movable member and movable with respect to said housing with said movable member;

wherein:

said displaceable element is positioned to be engaged by at least a finger of the hand of the operator and displaced by the finger to move said movable member and actuate said appliance;

said displaceable element further comprises an outer contact surface positioned for engagement with the finger of the operator when the hand of the operator is wrapped around said portion of said housing shaped to be engaged by the hand of an operator; and said contact surface includes an elastomeric surface of a predetermined thickness to provide sufficient resiliency for dampening vibrations caused by actuation of said appliance, for adapting to different operator fingers, and for cushioning the finger of the operator during actuation of said appliance by moving said displaceable element with respect to said portion of said housing shaped to be engaged by the hand of an operator;

wherein said displaceable element comprises a rigid basic structure and an elastomeric coating comprising said elastomeric surface; and wherein said rigid basic structure is shaped to accommodate said elastomeric coating.

10. A hand held electric appliance as in claim 9, wherein said elastomeric coating is glued to said rigid basic structure.

* * * * *